US009050770B1

(12) United States Patent
Russell et al.

(10) Patent No.: US 9,050,770 B1
(45) Date of Patent: Jun. 9, 2015

(54) METHOD OF MANUFACTURING A BOTTOM GUSSETED POUCH

(71) Applicants: James Russell, Shortsville, NY (US); John Ferber, Clifton Springs, NY (US)

(72) Inventors: James Russell, Shortsville, NY (US); John Ferber, Clifton Springs, NY (US)

( * ) Notice: Subject to any disclaimer, the term of this patent is extended or adjusted under 35 U.S.C. 154(b) by 0 days.

(21) Appl. No.: 14/467,138

(22) Filed: Aug. 25, 2014

(51) Int. Cl.
*B31B 1/64* (2006.01)
*B31B 37/00* (2006.01)
*B31B 23/00* (2006.01)

(52) U.S. Cl.
CPC ..... *B31B 37/00* (2013.01); *B31B 2237/20* (2013.01); *B31B 2237/50* (2013.01); *B31B 2237/10* (2013.01); *B31B 23/00* (2013.01)

(58) Field of Classification Search
CPC .... B31B 2237/10; B31B 23/00; B31B 37/00; B31B 2237/403; B31B 21/00; B31B 2221/10; B31B 2237/40; B31B 2219/146; B31B 2219/6092
See application file for complete search history.

(56) References Cited

U.S. PATENT DOCUMENTS

| | | | | |
|---|---|---|---|---|
| 2,154,521 | A | 4/1939 | Maxfield | |
| 3,051,103 | A | 8/1962 | Williams | |
| 3,203,323 | A | 8/1965 | Adams et al. | |
| 4,171,048 | A | 10/1979 | Ernst | |
| 4,285,681 | A | 8/1981 | Walitalo et al. | |
| 4,491,959 | A | 1/1985 | Loefberg | |
| 4,500,307 | A | 2/1985 | Bridgeman | |
| 4,561,107 | A | 12/1985 | Herder | |
| 4,816,104 | A | 3/1989 | Benoit | |
| 4,844,956 | A | 7/1989 | Galimberti | |
| 4,913,693 | A * | 4/1990 | Ball et al. | 493/194 |
| 5,816,018 | A * | 10/1998 | Bois | 53/133.4 |
| 6,068,585 | A * | 5/2000 | Ouchi | 493/213 |
| 6,135,281 | A | 10/2000 | Simhaee | |
| 6,416,452 | B1 * | 7/2002 | Meyer | 493/210 |
| 6,423,356 | B2 | 7/2002 | Richison et al. | |
| 6,425,847 | B1 * | 7/2002 | Broenstrup | 493/231 |
| 6,517,660 | B2 * | 2/2003 | Ausnit | 156/270 |
| 6,740,020 | B2 | 5/2004 | Horibe et al. | |
| 6,796,932 | B2 | 9/2004 | Kuge et al. | |
| 6,807,794 | B2 | 10/2004 | Ausnit et al. | |
| 7,093,978 | B2 | 8/2006 | Tan | |
| 7,325,378 | B2 | 2/2008 | Ausnit | |
| 7,490,451 | B2 | 2/2009 | Matthews | |
| 8,414,465 | B2 | 4/2013 | Totani | |
| 2005/0084184 | A1 | 4/2005 | Withers | |
| 2006/0115187 | A1 | 6/2006 | Ausnit et al. | |
| 2006/0194684 | A1 | 8/2006 | Tan | |
| 2008/0092487 | A1 | 4/2008 | Ausnit | |
| 2012/0085479 | A1 | 4/2012 | Goto | |

* cited by examiner

*Primary Examiner* — Sameh Tawfik
(74) *Attorney, Agent, or Firm* — Woods Oviatt Gilman LLP; Dennis B. Danella, Esq.

(57) ABSTRACT

A method of manufacturing a roll of bottom gusseted pouches serially connected in a top-to-bottom end orientation is provided. The method comprises unwinding a pouch webbing in a first flow direction, the pouch webbing defining front and back panels of a respective pouch; inserting a gusset webbing between the panels in a second flow direction; attaching the gusset webbing to the panels to form the bottom gusseted end of the pouch; inserting a closure mechanism between the panels in a third flow direction; attaching the closure mechanism to the panels to form the resealable top end of the pouch; sealing the side edges of the panels to complete the pouch; winding the completed pouch onto the roll; and repeating these steps to form the other bottom gusseted pouches in the roll. At least one of the pouch webbing and the gusset webbing is formed of a supported film.

16 Claims, 6 Drawing Sheets

METHOD OF MANUFACTURING A BOTTOM GUSSETED POUCH

FIELD OF THE INVENTION

The present invention is directed to a method of manufacturing a bottom gusseted pouch, wherein each of the pouches is formed at least in part of a multilayered supported film, and more particularly, in one aspect, to a method of manufacturing a plurality of bottom gusseted pouches wound onto a roll in a top-to-bottom end orientation. A bottom gusset webbing and a closure mechanism are inserted between opposing front and back panels in a direction that is transverse to a direction that a pouch webbing is being unwound. As the pouches are arranged in top-to-bottom end orientation, a more compact cylindrical roll of bottom gusseted pouches may be wound as compared to bottom gusset pouch rolls formed by insertion of the gusset webbing and closure mechanism in a direction that is parallel to the direction of pouch webbing flow.

BACKGROUND OF THE INVENTION

It is well known to use different types of pouches to serve as a container or packaging for many different types of consumer products, as well as food and beverage products. One type of pouch that is used for these types of products is referred to as a bottom gusseted pouch, wherein the bottom portion of the pouch includes a gusset that allows for the bottom to expand outwardly to provide additional storage spaced within the pouch. Further, when the bottom gusseted pouch is formed of a structured film, the pouch is capable of standing upright on a support surface.

A bottom gusseted pouch typically includes a top end, a bottom end, and opposing side edges that are connected with one another to define an interior compartment spaced therein. This type of pouch is typically manufactured in a side-by-side orientation so that the sides of each of the pouches are connected in series. In some cases, the flow of the web material used to form the front and back panels of the pouch is perpendicular to the longitudinal axis of the individual pouches. Further, the top end includes a zipper that allows the pouch to be selectively opened and closed to allow items to be placed within the interior compartment space. As previously mentioned, the bottom end includes a gusset that allows for expansion of the bottom portion of the pouch, which allows the finished pouch to remain in an upright position.

One significant problem with the side-to-side manufacturing orientation of the bottom gusseted pouches is that, after the pouches are manufactured, but not yet separated from one another, they cannot easily be rolled into a uniform cylindrical roll. In particular, such a roll would be non-uniform due to the increased amount of material used to form the bottom gusset at the bottom end of the pouch, as well as the zipper located at the top end of the pouch. The roll would have significant non-uniformities, such as bumps, that would make it difficult for a downstream packaging operation to use the roll in a subsequent filling process. Furthermore, the side-to-side manufacturing process requires that the pouches be opened, which creates a problem when the downstream filling process requires that the inside of the pouch be sterile. Also, side-to-side pouch manufacturing processes requires a significant amount of floor space in a manufacturing facility, which can be problematic in some instances.

As such, there is a need for a method for producing a roll of serially connected bottom gusseted pouches formed of structured film having a top-to-bottom end orientation to provide a compact cylindrical roll of completed bottom gusseted pouches. The present invention addresses this and other needs.

BRIEF SUMMARY OF THE INVENTION

One aspect of the present invention is directed to a method of manufacturing a roll of a plurality of bottom gusseted pouches with each respective pouch having a bottom gusseted end, a re-sealable top end and sealed first and second side edges. The plurality of pouches are serially connected in a top-to-bottom end orientation. The method comprises unwinding at least one pouch webbing in a first flow direction with the at least one pouch webbing defining front and back panels of a respective pouch. A gusset webbing is inserted between the front and back panels in a second flow direction which is transverse to the first flow direction. The gusset webbing is attached to the front and back panels to form the bottom gusseted end of the respective pouch. A closure mechanism is inserted between the front and back panels in a third flow direction which is transverse to the first flow direction. The closure mechanism may be attached to one or both of the front and back panels to form the resealable top end of the respective pouch. The gusset webbing and the closure mechanism are in spaced parallel relation. The closure mechanism is attached to one or both of the front and back panels to form the re-sealable top end of the respective pouch. The side edges of the front and back panels are sealed to complete the respective pouch. The completed respective pouch is wound onto the roll in the first flow direction and the steps are then repeated to form the other bottom gusseted pouches on the roll. The at least one of the pouch webbing and the gusset webbing is formed of a supported film, wherein the supported film includes at least a first film layer and a second film layer.

A further aspect of the present invention is directed to a method of manufacturing a bottom gusseted pouch having a bottom gusseted end, a top end having a fitment, and sealed first and second side edges. The method comprises unwinding at least one pouch webbing in a first flow direction. The at least one pouch webbing forms front and back panels of the bottom gusseted pouch. A gusset webbing is inserted between the front and back panels in a second flow direction which is transverse to the first flow direction. The gusset webbing is attached to the front and back panels to form the bottom gusseted end of the pouch. The side edges of the front and back panels are sealed such that the sealed side edges and bottom gusseted end define a pouch compartment. At least a portion of the fitment is positioned between the front and back panels adjacent to the top end of the pouch. The fitment is then sealed to the front and back panels of the pouch to provide selective access to the pouch compartment. At least one of the pouch webbing and the gusset webbing is formed of a supported film, wherein the supported film includes at least a first film layer and a second film layer.

A still further aspect of the present invention is directed to a method of filling a respective bottom gusseted pouch on a roll of bottom gusseted pouches. The respective bottom gusseted pouch includes front and back panels, a bottom gusset, a top end, and sealed first and second side edges. One or more of the front panel, back panel and bottom gusset is a supported film including first and second film layers, wherein the first film layer has a lower heat index that the second film layer. The method comprises unwinding the roll of bottom gusseted pouches so that the bottom gusset of the respective bottom gusseted pouch is located vertically below the top end of the respective bottom gusseted pouch. The top end of the respective bottom gusseted pouch is opened so that the front and back panels and the bottom gusset define an open compartment therein. The compartment is then filled with at least one item so as to produce a filled pouch. The top end is then sealed and the filled pouch is cut from the roll of bottom gusseted pouches by cutting between the top end of the filled pouch and a bottom gusset of a next succeeding pouch.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
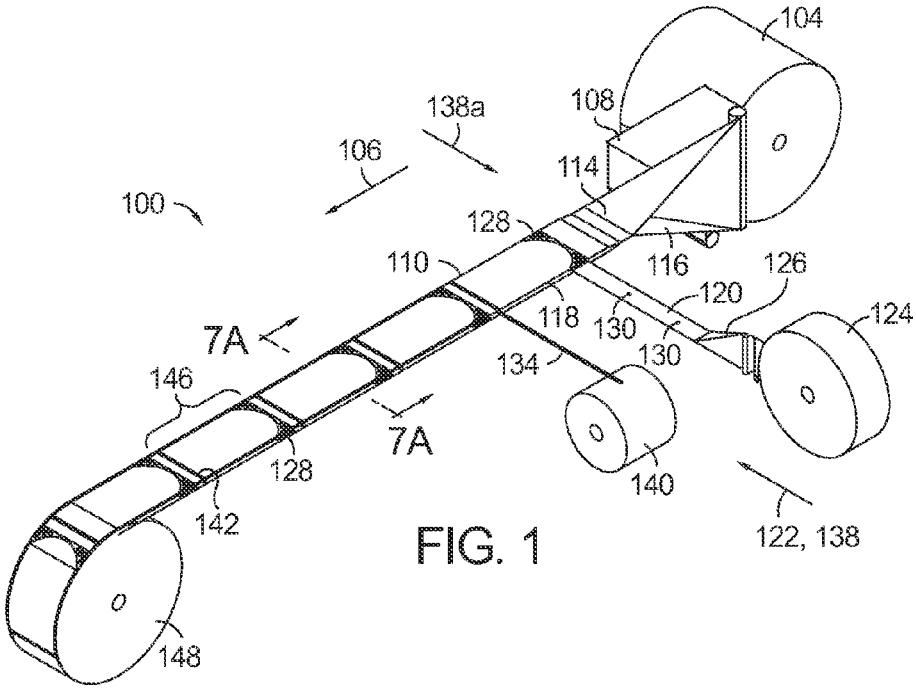
FIG. 1 is a perspective schematic view of a method for manufacturing a roll of a plurality of bottom gusseted pouches according to one embodiment of the present invention.
Figure 2A:
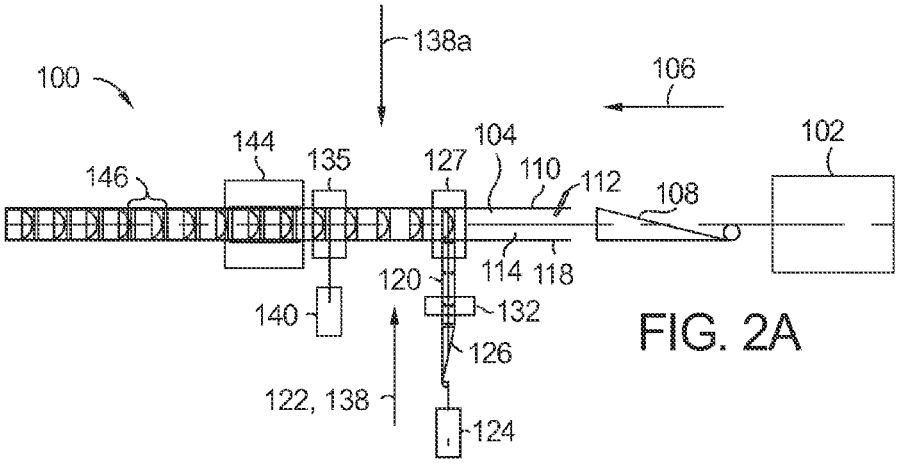
FIG. 2A is a top schematic view of the method shown in FIG. 1.
Figure 2B:
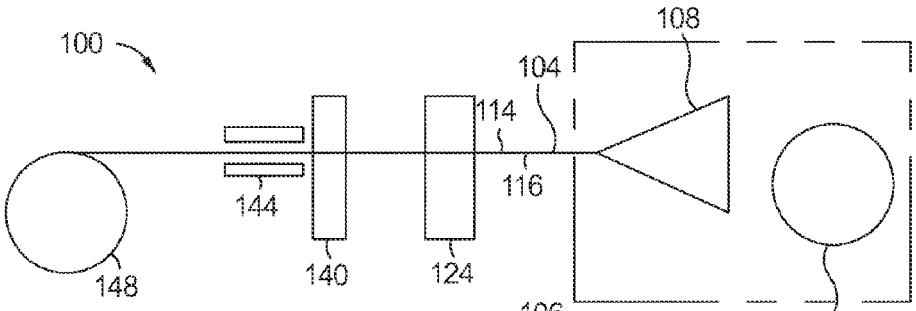
FIG. 2B is a side schematic view of the method shown in FIG. 1.

Referring to the drawings in detail, and specifically to FIGS. 1, 2A and 2B, reference numeral 100 generally designates a method of manufacturing a roll of a plurality of bottom gusseted pouches in accordance with one aspect of the present invention. By forming the bottom gusseted pouches from a structured film in a top-to-bottom orientation in accordance with the present invention, the plurality of completed bottom gusseted pouches can be wound into a cylindrical roll, which allows the pouches to be stored, transported and filled in an efficient manner.

To initiate method 100, a single roll 102 of pouch webbing 104 is unwound in a first flow direction 106 and folded within a webbing folder 108 to form a folded pouch webbing. In accordance with one embodiment of the present invention, pouch webbing 104 is folded in a direction that is parallel to, or along, a longitudinal axis of pouch webbing 104 to form a seam along an edge 110. The pouch webbing 104 is then sliced along the seam using a seam slitter 112 (see FIG. 2A) to form a front panel 114 and a back panel 116, each having aligned edges 110 and 118.

With front panel 114 and back panel 116 formed and positioned on top of one another, a bottom gusset webbing 120 may be inserted between front and back panels 114, 116 in a second flow direction 122 which is transverse to first flow direction 106 of pouch webbing 104. Prior to inserting gusset webbing 120 between front and back panels 114, 116, gusset webbing 120 is drawn from a gusset webbing roll 124 in second flow direction 122 and may be folded in a direction that is parallel to, or along, its longitudinal axis by a gusset folder 126. The folded gusset webbing 120 allows for the expansion of a bottom end of a completed pouch upon filling, and also provides a wider base such that the completed pouch can freely stand upon its gusseted end. After the desired length of gusset webbing 120 has been inserted between front and back panels 114, 116, gusset webbing 120 is then cut from gusset roll 124. The inserted gusset webbing 120 is then sealed to an inner surface of each of front panel 114 and back panel 116 using a heat sealer 127 to form a heat seal 128 at a bottom end of gusseted pouch. While gusset webbing 120 is described above as being cut before being sealed to front and back panels 114, 116, it is also within the scope of the invention to seal gusset webbing 120 to front and back panels 114, 116 prior to being cut from gusset roll 124. Furthermore, gusset webbing 120 may further have one or more gusset holes 130 defined therein by a gusset punch 132 (see FIG. 2A) prior to gusset webbing 120 being inserted between front and back panels 114, 116. Gusset holes 130 assist in sealing the gusset webbing 120 to front and back panels 114, 116 by allowing front and back panels 114, 116 to be heat sealed directly to one another through gusset holes 130 in order to maintain the position of gusset webbing 120 relative to front and back panels 114, 116.

A top end of a respective bottom gusseted pouch may include a closure mechanism 134 to allow selective access to an interior compartment 136 (FIGS. 7A, 7B) of the pouch to allow for the pouch to be filled and to allow a user to remove items contained within interior compartment 136. It should be understood that any suitable closure mechanism may be employed, including, but not limited to, a zipper mechanism, an adhesive, mating hook-and-loop materials, a slider mechanism, and rib-and-groove fasteners. Closure mechanism 134 is inserted between panels 114, 116 in a third flow direction 138 which is transverse to first flow direction 106 of pouch webbing 104. In accordance with one aspect of the present invention, second flow direction 122 (i.e., the flow direction of gusset webbing 120) may be the same as third flow direction 138 of closure mechanism 134 such that gusset webbing 120 and closure mechanism 134 are inserted from the same side of pouch webbing 104. Alternatively, second flow direction 122 may be opposite that of third flow direction 138*a* such that gusset webbing 120 is inserted from one side of pouch webbing 104 while closure mechanism 134 is inserted from the opposite side of pouch webbing 104.

In accordance with one aspect of the present invention, closure mechanism 134 is continually supplied by unwinding a closure roll 140 and closure mechanism 134 is inserted between front and back panels 114, 116. After the desired length of the closure mechanism 134 has been inserted between front and back panels 114, 116, closure mechanism 134 is then cut from closure roll 140 and sealed to the inner surface of one or both of front panel 114 and back panel 116 by mechanism 135 to form a resealable top end 142 of the bottom gusseted pouch. While closure mechanism 134 is described above as being cut before being sealed, it is also within the scope of the present invention that closure mechanism 134 may be sealed to one or both of front and back panels 114, 116 prior to being cut from closure roll 140. Further, closure mechanism 134 may be inserted between front and back panels 114, 116 at the same time that the gusset webbing 120 is being inserted between front and back panels 114, 116. Alternatively, closure mechanism 134 and gusset webbing 120 may be inserted in serial fashion with insertion of either the closure mechanism 134 or gusset webbing 120 sequentially following the insertion of the other.

Once gusset webbing 120 and closure mechanism 134 have been inserted and sealed to one or both of front and back panels 114, 116, an in-line sealer 144 operates to heat seal the side edges 110, 118 of front panel 114 and back panel 116 to form a completed respective bottom gusseted pouch 146 that remains connected to adjacent completed respective bottom gusseted pouches in a top-to-bottom end orientation. The completed bottom gusseted pouches 146 are then wound to form a finished cylindrical roll 148 for use in a subsequent filling process, such as the filling process that will be described below with reference to FIGS. 8-10.

It should be noted that the entire method of manufacturing the bottom gusseted pouches is conducted while pouch webbing 104 is under tension, including when the heat seal is applied to seal the side edges 110, 118 of front and back panels 114, 116, and to seal the gusset webbing 120 to front and back panels 114, 116 to form the bottom end of pouch 146. While any suitable amount of tension may be applied to pouch webbing 104 during production, in accordance with an aspect of the present invention, manufacturing method 100 proceeds wherein pouch webbing 104 is under a web tension of between about 1 N/m to about 20 kN/m, and more particularly between about 45 N/m to about 10 kN/m, and in a preferred embodiment between about 75 N/m to about 1 kN/m. While specific ranges have been provided, it should be understood that any desired amount of tension may be used, with such amount of tension determined based at least in part on the type and thickness of the pouch webbing materials being used, the number and thickness of any laminate layers within the pouch webbing material and the desired seal characteristics of the completed pouches. Such additional amounts of tension should be considered within the scope of the present invention.

Figure 3:
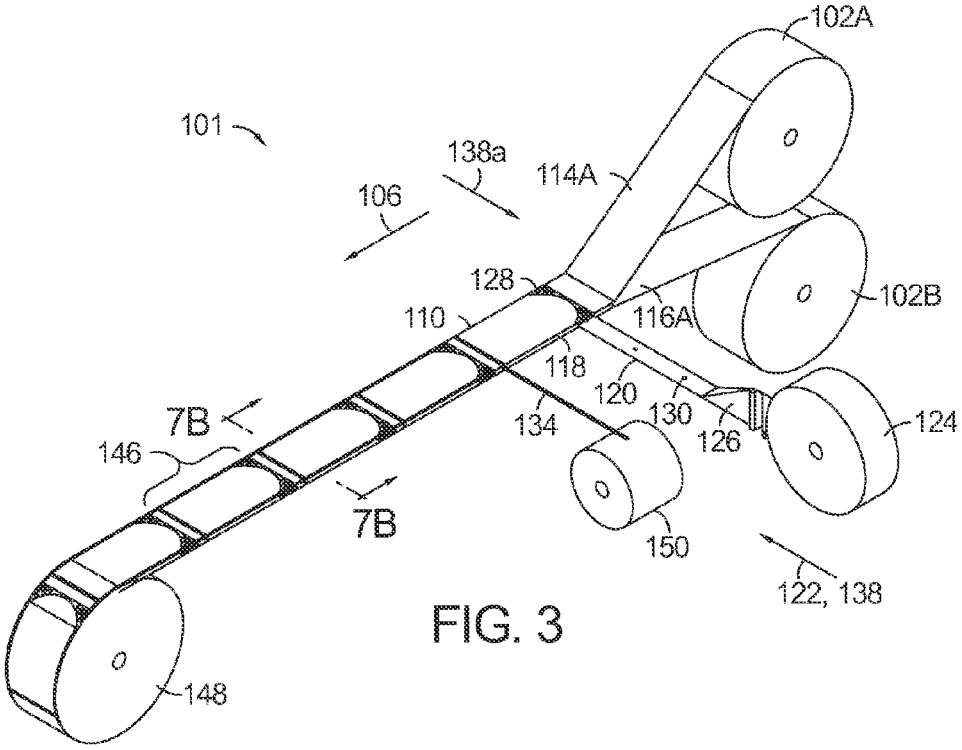
FIG. 3 is an alternative embodiment of a method for manufacturing a roll of a plurality of bottom gusseted pouches in accordance with the present invention.
Figure 4:
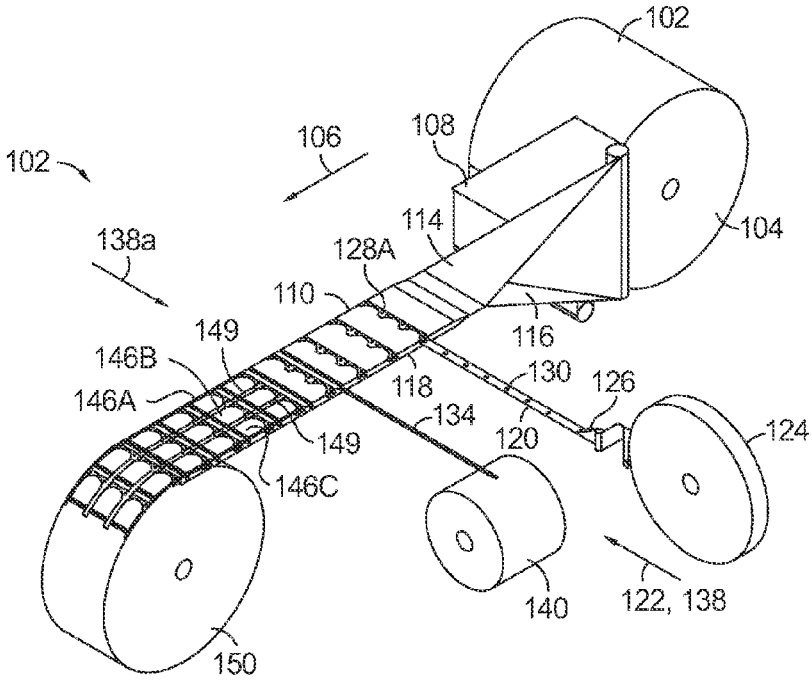
FIG. 4 is a further alternative embodiment of a method for manufacturing a roll of a plurality of bottom gusseted pouches in accordance with the present invention showing the manufacture of a plurality of side-by-side connected pouches within the roll.

Alternative embodiments of a method of manufacturing a roll of a plurality of bottom gusseted pouches in accordance with present invention are shown in FIGS. 3 and 4. Alternative manufacturing method 101, shown in FIG. 3, is similar to method 100 shown in FIGS. 1, 2A and 2B except for how the pouch webbing material is provided. As described above with regard to method 100, pouch webbing 104 is a single sheet webbing that is folded by webbing folder 108 and slit by seam slitter 112 to form front panel 114 and back panel 116. In the alternative embodiment shown in FIG. 3, front panel 114A and back panel 116A are constructed from separate pouch webbing rolls 102A, 102B, respectively. In accordance with one aspect of the invention, pouch webbing rolls 102A and 102B are arranged such that unwinding of rolls 102A, 102B in first flow direction 106 places the webbing material of front panel 114A on top of and in spaced parallel relation with the webbing material of back panel 116A such that opposing edges 110, 118 may be aligned. In this manner, the remainder of the method as described above with regard to method 100 may be employed. That is, the gusset webbing 120 may be inserted, sealed and cut, closure mechanism 134 may be inserted, sealed and cut, the side edges 110, 118 may be sealed, and the resultant finished pouches 146 may be wound onto roll 148 for filling. As webbing rolls 102A, 102B are independent from one another with each roll 102A, 102B forming its respective panel 114A, 116A, it should be understood that front panel 114A may be constructed of a different material that back panel 116A. In accordance with an aspect of the invention, one or both sides of either or both panels 114A, 116A may include printed matter. Front and back panels 114A, 116A may also be adjusted to obtain front-to-back print registration.

Turning now to FIG. 4, another manufacturing method 103 is provided. Most aspects of method 103 are similar to method 100 as described above with regard to FIGS. 1, 2A and 2B except for the aspect of sealing gusset webbing 120 between front and back panels 114, 116 and forming one or more heat seals between, and parallel to, side edges 110,118 to form pouches connected in a side-by-side orientation within the roll of pouches. As shown in FIG. 4, bottom gusset webbing 120 is sealed 128A between front and back panels 114, 116 in a scalloped pattern wherein open ends of the scallop identify the locations of the side walls of respective lateral pouches within the pouch webbing sheet material. Gusset webbing 120 may include a plurality of gusset holes 130, wherein each hole 130 is positioned to coincide with the open ends of the scalloped seal 128A to enable sealing of front panel 114 to back panel 116 though each gusset hole 130.

Following insertion, sealing and cutting of closure mechanism 134, in-line sealer 144 (such as that shown in FIGS. 2A and 2B) is adapted to seal side edges 110, 118 while also creating one or more heat seals 149 parallel to side edges 110, 118, wherein the internal heat seal coincides with the open ends of scalloped gusset webbing seal 128A. In this manner, a plurality of laterally connected pouches (e.g., pouches 146A, 146B, 146C) may be manufactured and sealed before being wound onto completed pouch roll 150. It should be noted that, while shown and described as employing a single sheet pouch webbing roll 102 and webbing folder 108 to produce front panel 114 and back panel 116, it is within the scope of the present invention that manufacturing method 103 may utilize an independent front panel pouch webbing roll and back panel pouch webbing roll similar to those shown and described above with regard to FIG. 3 and manufacturing method 101.

Figure 5:
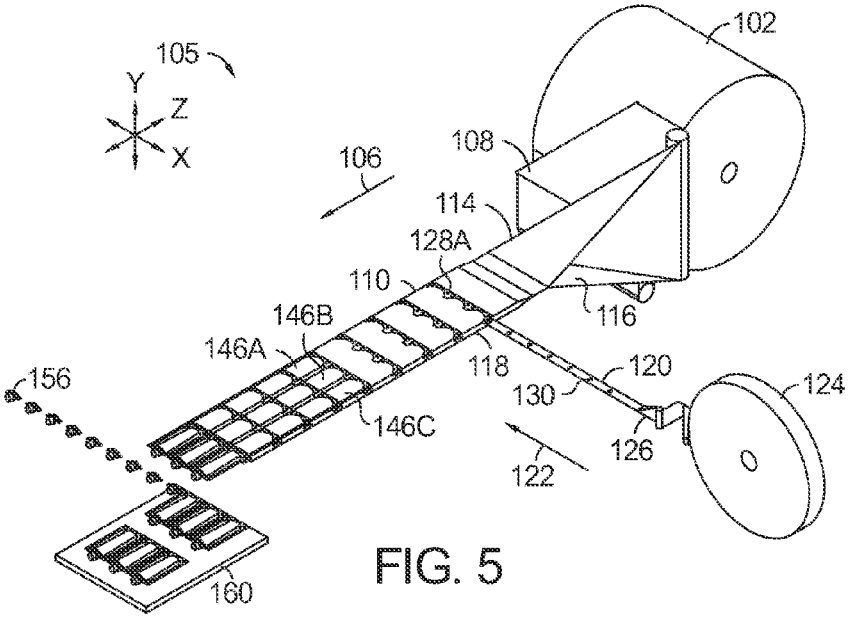
FIG. 5 is a perspective schematic view of yet another embodiment of a method for manufacturing a bottom gusseted pouch having a fitment in accordance with the present invention.
Figure 6A:
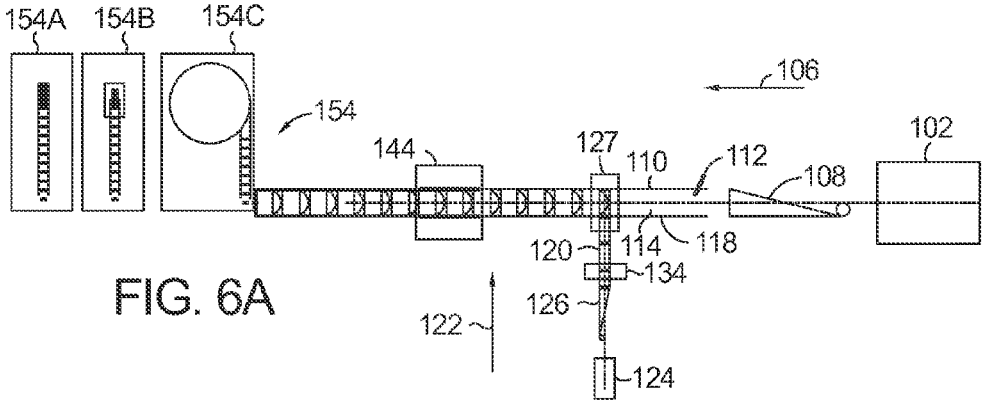
FIG. 6A is a top view schematic of the method shown in FIG. 5.
Figure 6B:
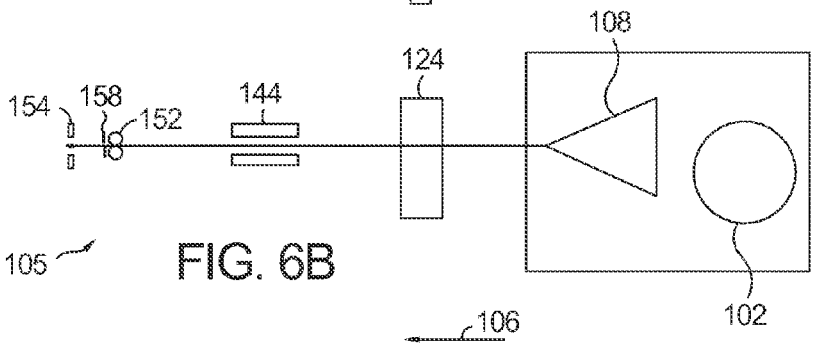
FIG. 6B is a side view schematic of the method shown in FIG. 5.

Referring to FIGS. 5, 6A and 6B, reference numeral 105 generally designates a method of manufacturing a bottom gusseted pouch including a fitment in accordance with another aspect of the present invention. Similar to method 100 described above, to initiate method 105, a single pouch webbing roll 102 is unwound in first flow direction 106 and folded within webbing folder 118 to create a folded pouch webbing. For example, pouch webbing roll 102 may be folded evenly along its longitudinal axis to form a seam along webbing edge 110. The seam is then sliced open via seam slitter 112 (FIG. 6A) to form front panel 114 and back panel 116, each having edges 110 and 118.

With front and back panels 114, 116 formed and positioned on top of one another, gusset webbing 120 is inserted between front and back panels 114, 116 in second flow direction 122 that is transverse to first flow direction 106 of pouch webbing 104. Gusset webbing 120 is unwound from gusset webbing roll 124 and may be folded evenly along is longitudinal axis by gusset folder 126. As previously mentioned, the folded gusset webbing allows for the expansion of the completed pouch upon filling, and also provides a wider base such that the completed pouch can freely stand upon its bottom gusseted end. After the desired length of gusset webbing 120 has been inserted, gusset webbing 120 is then cut from gusset roll 124. The inserted gusset webbing 120 is then sealed to the inner surface of each of front panel 114 and back panel 116 to form the bottom gusseted pouch at a gusset seal similar to gusset seal 128 as shown in FIG. 1, or as a scalloped bottom gusset seal 128A as shown in FIG. 5 to form laterally connected side-by-side oriented pouches similar to those described above with regard to FIG. 4. While described above as being cut before being sealed, it is within the scope of the invention that gusset webbing 120 may be sealed to front and back panels 114, 116 prior to being cut from gusset roll 124. Gusset webbing 120 may further have one or more gusset holes 130 defined therein by gusset punch 132 (see FIG. 6A) as was described above.

Once gusset webbing 120 has been inserted and sealed to front and back panels 114, 116, in-line sealer 144 (such as that shown in FIGS. 6A and 6B) is adapted to seal side edges 110, 118 to form a single pouch, or may further create one or more heat seals parallel to side edges 110, 118, wherein the internal heat seal coincides with the open ends of scalloped gusset webbing seal 128A. In this manner, as shown in FIG. 5, a plurality of laterally connected side-by-side oriented pouches (e.g., pouches 146A, 146B, 146C) may be manufactured as pouch webbing 104 advances in first flow direction 106 (i.e. the direction of unwinding pouch roll 102). While shown and described as producing laterally connected side-by-side pouches 146A, 146B, 146C connected serially in a top-to-bottom end configuration, it is to be understood by those skilled in the art that individual bottom gusseted pouches connected serially in a top-to-bottom end configuration may be formed according to this method analogously to those formed in method 100 described above.

Once the side edges 110, 118 of front and back panels 114, 116 are sealed to one another, and bottom gusset webbing 120 are sealed to front and back panels 114, 116, pouches 146A, 146B, 146C are advanced by one or more web feed rollers 152 until the open top ends of pouches 146A, 146B, 146C engage a fitment feed and seal device 154, wherein a fitment 156 is positioned between front and back panels 114, 116, and sealed to the open top end of each pouch to produce a completed bottom gusseted pouch with integral fitment. Fitment 156 may include, but is not limited to, a cylindrical spout that is configured to selectively receive a fitment cap to allow contents contained within a completed pouch to be poured out of the completed pouch. Examples of suitable fitment feed and seal device 154 include, but are not limited to, a roll feed device 154A, a magazine feed device 154B or a bowl feed device 154C. Once fitment 156 has been inserted and sealed to the pouch, the completed pouch with fitment may be disconnected from the adjacently connected pouches by a pouch cutter 158. The completed pouches are then arranged for later use, such as by palletizing on a pallet 160.

In accordance with an aspect of the present invention, fitment feed and seal device 154 is adapted to provide monitoring and manipulation of each fitment 156 with respect to the fitment's 156 alignment with the open top end of pouches 146A, 146B, and/or 146C. In particular, fitment feed and seal device 154 is configured for controlling the position and orientation of fitment 156 (such as along any or all Cartesian axes: x, y, z) to ensure proper alignment of fitment 156 between front and back panels 114, 116 of the pouch and minimize, and preferably eliminate, any misalignments and subsequent mis-seals of fitment 156 with the top end of the respective pouch. Fitment 156 position and orientation is maintained through the servo-feed and indexing of the pouch forming machine (such as that one used in method 105) which allows for accurate positioning of pouch 146 (or pouches 146A, 146B, 146C) with respect to fitment feed and seal device 154. Proper positioning of pouch 146 (pouches 146A, 146B, 146C) also assists in releasing the completed pouches from the tension section of the machine through pouch cutter 158 while minimizing the risk of improperly slicing the sealed portion of the completed pouch or pouches.

Figure 7A:
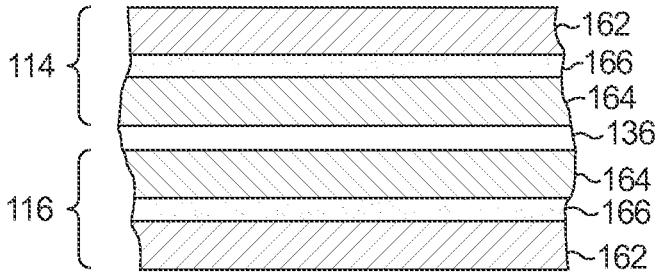
FIG. 7A is a cross sectional view one exemplary structured film webbing material that may be used in an embodiment of a method for manufacturing a bottom gusseted pouch in accordance with the present invention.
Figure 7B:
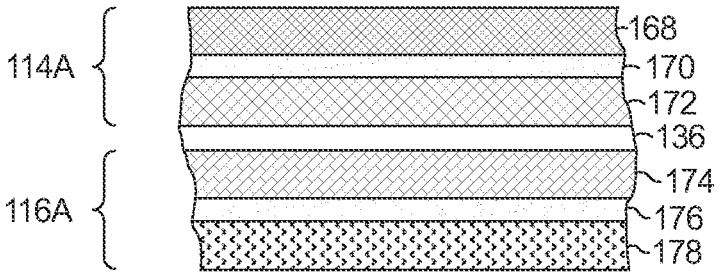
FIG. 7B is a cross sectional view of another exemplary webbing material that may be used in an embodiment of a method for manufacturing a bottom gusseted pouch in accordance with the present invention.

With regard to FIGS. 7A and 7B, one aspect of the present invention utilizes webbing materials comprised of supported films including at least a first film layer and a second film layer. That is, the webbing material, such as pouch webbing 104 and/or gusset webbing 120, may be comprised of a multilayer film, and more preferably of a multiplayer film wherein at least two of the individual film layers within the multilayer film have different heat indexes. In accordance with an aspect of the present invention, the film having the higher heat index forms the outer layer of the bottom gusseted pouch while the film having the lower heat index forms the inner layer of the bottom gusseted pouch (i.e. defines the interior compartment). In this manner, the magnitude of the heat applied to the pouch webbing when forming the heat seal is selected such that the magnitude is greater than the heat index of the inner layer yet below that of the outer layer. As a result, the inner layers of respective front panel, back panel or gusset webbing fuse together to form the requisite seal without distorting or otherwise damaging the outer layer of the pouch.

The use of supported films in the present method may be used to construct one or more of front panel 114, 114A, back panel 116,116A, and bottom gusset 120. For instance, as shown in FIG. 7A, when using a single sheet webbing 104 for front and back panels 114, 116 (such as that shown in FIGS. 1, 4 and 5) or for folded gusset webbing 120 (FIGS. 1, 3-5), folding of the sheet will result in the outer surface of the sheet being a first film layer 162 with the opposing surface becoming the inner surface of the sheet including a second film layer 164 defining an interior compartment 136 of the pouch. Further, a third film layer 166, such as a tie layer, may be positioned between first and second film layers 162, 164, and have the same heat index of one of the first or second film layers 162, 164, or have a heat index that is different than first and second film layers 160, 164. Alternatively, as shown in FIG. 7B, front panel 114A may be constructed of different materials (film layers 168, 170, 172) than back panel 114B (film layers 174, 176, 178) as desired or dictated by the proposed end use of the pouch using the two pouch roll 102A, 102B shown in the method 101 (FIG. 3).

The supported films may be constructed by any known or future developed manufacturing process, including but not limited to, lamination, extrusion, coextrusion or combinations thereof. While it has been shown and described herein to use three film layers to form the structured film that makes up the webbing, it should be understood that it is within the scope of the present invention to utilize webbing that includes two film layers and more than three film layers. Examples of such film layers include layers imparting desired performance characteristics to the completed pouches such as desired adhesive properties/strengths, moisture barrier/permeability, oxygen barrier/permeability, and the ability to print onto the layer. Materials which may comprise one or more layers within the multilayer film include polymeric/copolymeric films formed of materials, such as, but not limited to, nylon, polyethylene, polypropylene, polyester, polylactic acid, polyvinyl chloride, and any weights, modifications and/or orientations of such polymers; metal films such as aluminum; metal coatings such as aluminum oxide; and combinations thereof.

Figure 8:
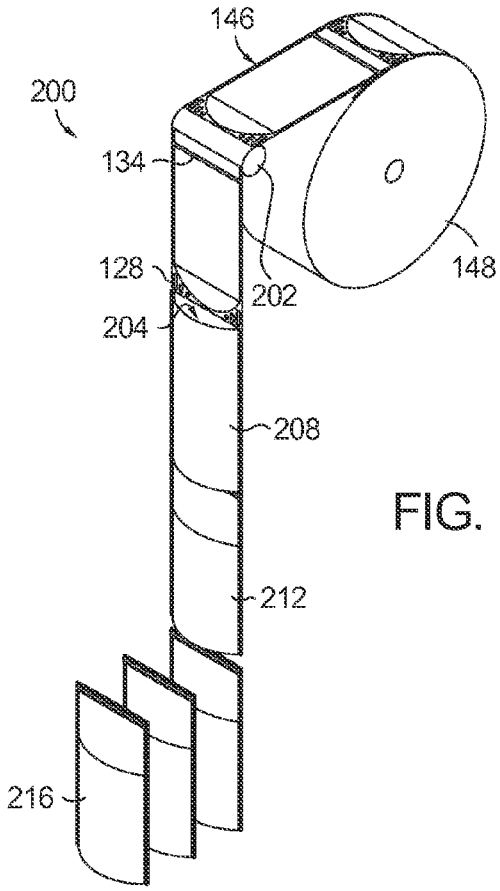
FIG. 8 is a perspective schematic view embodiment of a method for filling a bottom gusseted pouch in accordance with the present invention.
Figure 9:
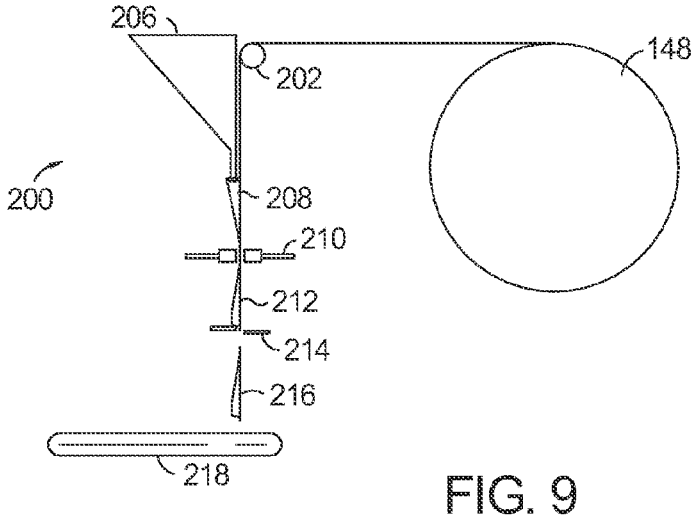
FIG. 9 is a side view of the method shown in FIG. 8.

Referring now to FIGS. 8 and 9, reference numeral 200 generally designates a method of filling a bottom gusseted pouch 146 in accordance with another aspect of the present invention. As can be seen in the drawings, a roll of bottom gusseted pouches, such as roll 148, produced using manufacturing method 100 described above, is unwound and draped over a roller 202 such that the bottom gusset seal 128 of a respective pouch 146 is positioned vertically below its respective top closure mechanism 134. The top closure mechanism 134 is then opened so as to define an opening 204 within pouch 146. A filling apparatus, such as hopper 206 then dispenses one or more items through opening 204 and into the interior compartment 136 to create a filled pouch 208. The items placed within interior compartment may be any type of consumer product, as well as food and beverage products. Filled pouch 208 then advances to a pouch sealer 210 where filled pouch 208 is sealed closed. In accordance with an embodiment of the invention, pouch sealer 210 may operate to re-secure top closure mechanism 134. In a further embodiment, pouch sealer 210 operates to create a heat seal above top closure mechanism 134, but below gusset seal 128 of the next succeeding filled pouch 208. The sealed pouch 212 is then cut from the pouch roll 148 by pouch cutter 214. The cut and filled pouch 216 may then be directed to a stacking/packaging/palletizing location by way of conveyor 218.

Figure 10:
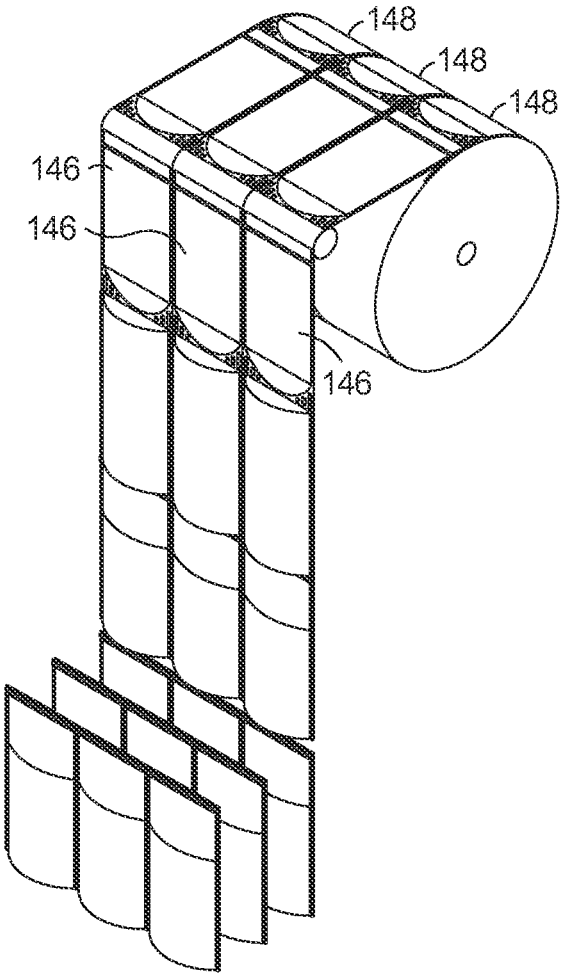
FIG. 10 is a perspective schematic view embodiment of a method for filling a plurality bottom gusseted pouch in accordance with the present invention.

As shown in FIG. 10, filling method 200 may be scalable such that a plurality of pouch rolls 148 may be arranged in side-by-side orientation such that each pouch 146 on respective rolls may be unwound, filled, sealed, and cut in parallel fashion to increase the filling efficiency.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A method of manufacturing a roll of a plurality of bottom gusseted pouches with each respective pouch having a bottom gusseted end, a resealable top end and sealed first and second side edges, the plurality of pouches being serially connected in a top-to-bottom end orientation, the method comprising:

a) unwinding at least one pouch webbing in a first flow direction, the at least one pouch webbing defining front and back panels of a respective pouch;

b) inserting a gusset webbing between the front and back panels in a second flow direction which is transverse to the first flow direction;

c) attaching the gusset webbing to the front and back panels to form the bottom gusseted end of the respective pouch;

d) inserting a closure mechanism between the front and back panels in a third flow direction which is transverse to the first flow direction, wherein the gusset webbing and the closure mechanism are in spaced parallel relation;

e) attaching the closure mechanism to one or both of the front and back panels to form the resealable top end of the respective pouch;

f) sealing the side edges of the front and back panels to complete the respective pouch;

g) winding the completed respective pouch onto the roll in the first flow direction; and h) repeating elements a) through g) to form the other bottom gusseted pouches in the roll, wherein at least one of the pouch webbing and the gusset webbing is formed of a supported film, wherein the supported film includes at least a first film layer and a second film layer.

2. The method in accordance with claim 1, wherein the step of inserting the gusset webbing further includes:

i) unwinding the gusset webbing from a gusset webbing roll and folding the gusset webbing evenly along a longitudinal axis of the gusset webbing before the gusset webbing is inserted between the front and back panels, wherein the longitudinal axis is parallel to the second flow direction; and ii) cutting the gusset webbing from the gusset webbing roll proximate the first or second side edge after inserting the gusset webbing between the front and back panels.

3. The method in accordance with claim 1, wherein the step of inserting the closure mechanism further includes:

i) unwinding the closure mechanism from a closure mechanism roll before inserting the closure mechanism between the front and back panels; and ii) cutting the closure mechanism from the closure mechanism roll proximate said first or second side edge after inserting the closure mechanism between the front and back panels.

4. The method in accordance with claim 1, wherein steps (b) and (c) are performed simultaneously with steps (d) and (e).

5. The method in accordance with claim 1, wherein the first film layer has a lower heat index than the second film layer, and wherein the second film layer is an outer surface of one or more of the front panel, the back panel, and the gusset webbing.

6. The method in accordance with claim 1, wherein at least one of the first film layer and the second film layer is formed of nylon, polyethylene, polypropylene, polyester, a metal foil, or combinations thereof.

7. The method in accordance with claim 6, wherein two or more of the front panel, the back panel, and the gusset webbing are formed of different materials.

8. The method in accordance with claim 1, wherein the supported film is fabricated by lamination, extrusion, coextrusion, or combinations thereof.

9. The method in accordance with claim 1, wherein one or both of the steps of attaching the gusset webbing and attaching the closure mechanism is conducted using a heat seal.

10. The method in accordance with claim 1, wherein the steps of attaching the gusset webbing, attaching the closure mechanism and sealing the side walls to the front and back panels are conducted when the pouch webbing is under tension.

11. The method in accordance with claim 1, wherein step (f) further comprises sealing the front and back panels in one or more locations between the side edges, wherein the one or more locations are directed parallel to the first flow direction to create a plurality of side-to-side connected bottom gusseted pouches.

12. The method in accordance with claim 1, wherein the gusset webbing includes at least one gusset hole defined therein, and wherein the front panel and the back panel are attached to one another through the at least one gusset hole.

13. The method in accordance with claim 1, wherein the step of unwinding the at least one pouch webbing includes:

i) unwinding a pouch webbing sheet;

ii) folding the unwound pouch webbing sheet evenly along a longitudinal axis of the pouch webbing sheet to form a seam; and iii) cutting the folded pouch webbing sheet at the seam to form the front and back panels.

14. The method in accordance with claim 1, wherein the step of unwinding the at least one pouch webbing includes:

i) unwinding a first pouch webbing sheet to form the front panel; and ii) unwinding a second pouch webbing sheet in spaced parallel relation with the first pouch webbing sheet to form the back panel.

15. The method in accordance with claim 1, wherein the second flow direction and the third flow direction are the same direction.

16. The method in accordance with claim 1, wherein the second flow direction and the third flow direction are in opposite directions.

* * * * *